United States Patent [19]

Holland

[11] 4,416,743

[45] Nov. 22, 1983

[54] ELECTROLYSIS USING TWO ELECTROLYTICALLY CONDUCTING PHASES

[75] Inventor: Frank S. Holland, Hazel Grove Stockport, England

[73] Assignee: Manchem Limited, Manchester, England

[21] Appl. No.: 456,315

[22] Filed: Jan. 6, 1983

[30] Foreign Application Priority Data

Jan. 7, 1982 [GB] United Kingdom ..... 8200355

[51] Int. Cl.[3] ..... C25B 1/00; C25C 1/02; C25C 1/08; C25C 1/16

[52] U.S. Cl. ..... 204/59 R; 204/59 M

[58] Field of Search ..... 204/59 R, 59 M

[56] References Cited

U.S. PATENT DOCUMENTS

| | | | |
|---|---|---|---|
| 3,006,824 | 10/1961 | Story | 204/59 AM |
| 3,361,781 | 1/1968 | Ziegler | 204/59 QM |
| 3,707,407 | 12/1972 | Chilton et al. | 204/59 QM |
| 4,208,255 | 6/1980 | Stahl et al. | 204/59 R |

*Primary Examiner*—R. L. Andrews

[57] ABSTRACT

An electrolysis system and method are disclosed having at least two electrolyte phases, one of which is aqueous and another of which is aqueous-immiscible wherein the inter-facial current passage is ionic rather than electronic. Electrode contact with such electrolytes is limited to a single electrolyte for each electrode. The system can be used for the production of elemental metals from compounds containing the same, for the purification of impure metals, and for the conducting of electrolytic redox reactions with water-immiscible species.

19 Claims, 6 Drawing Figures

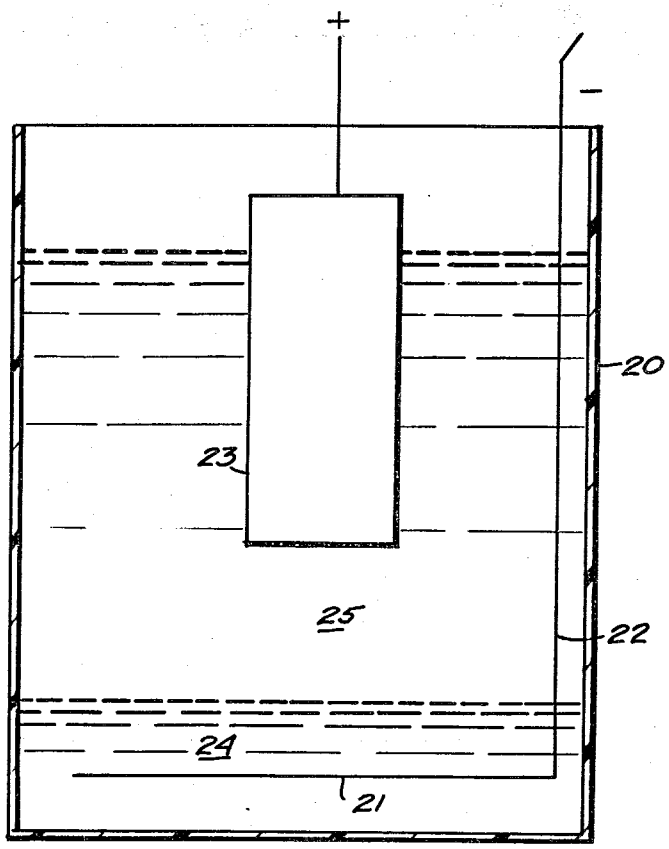
Fig. II
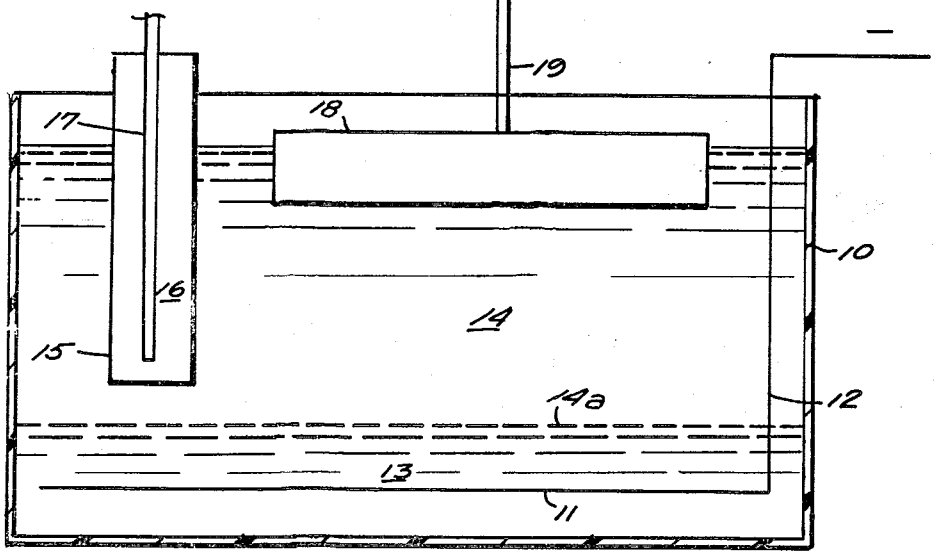
Fig. I

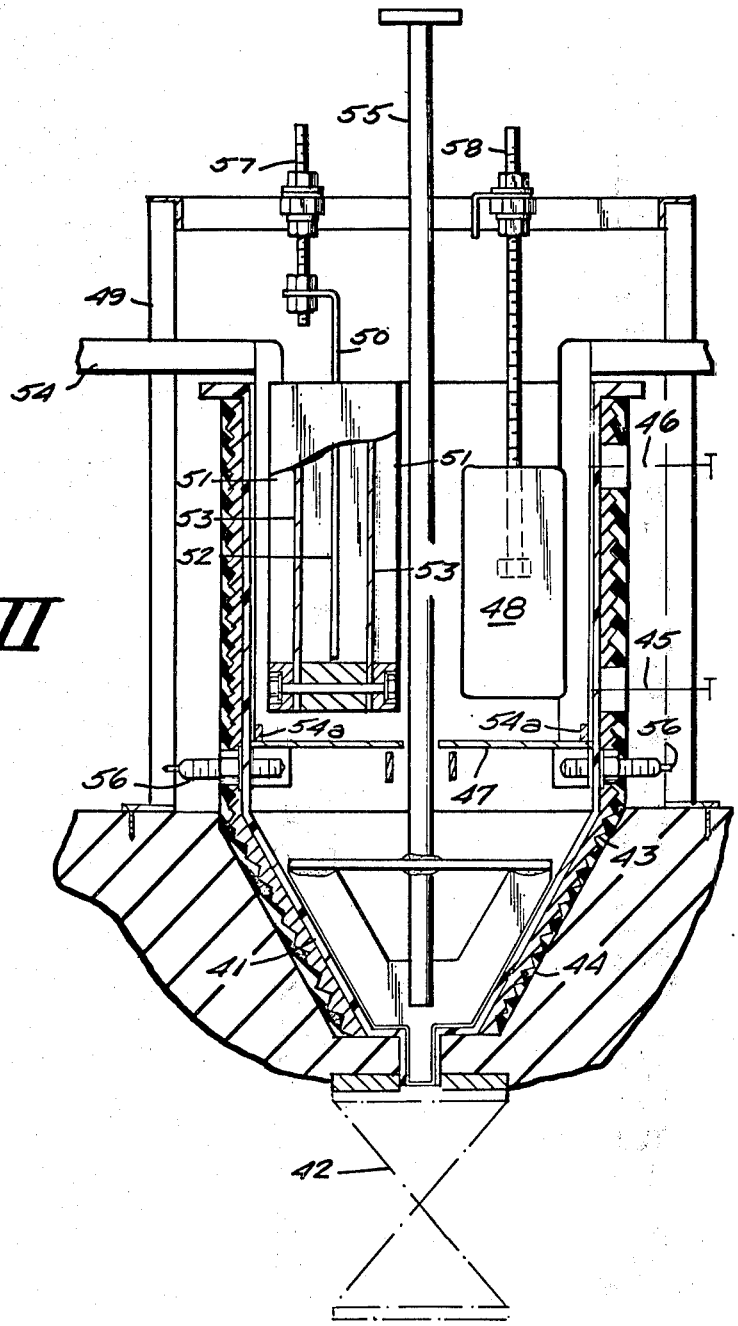
Fig. III

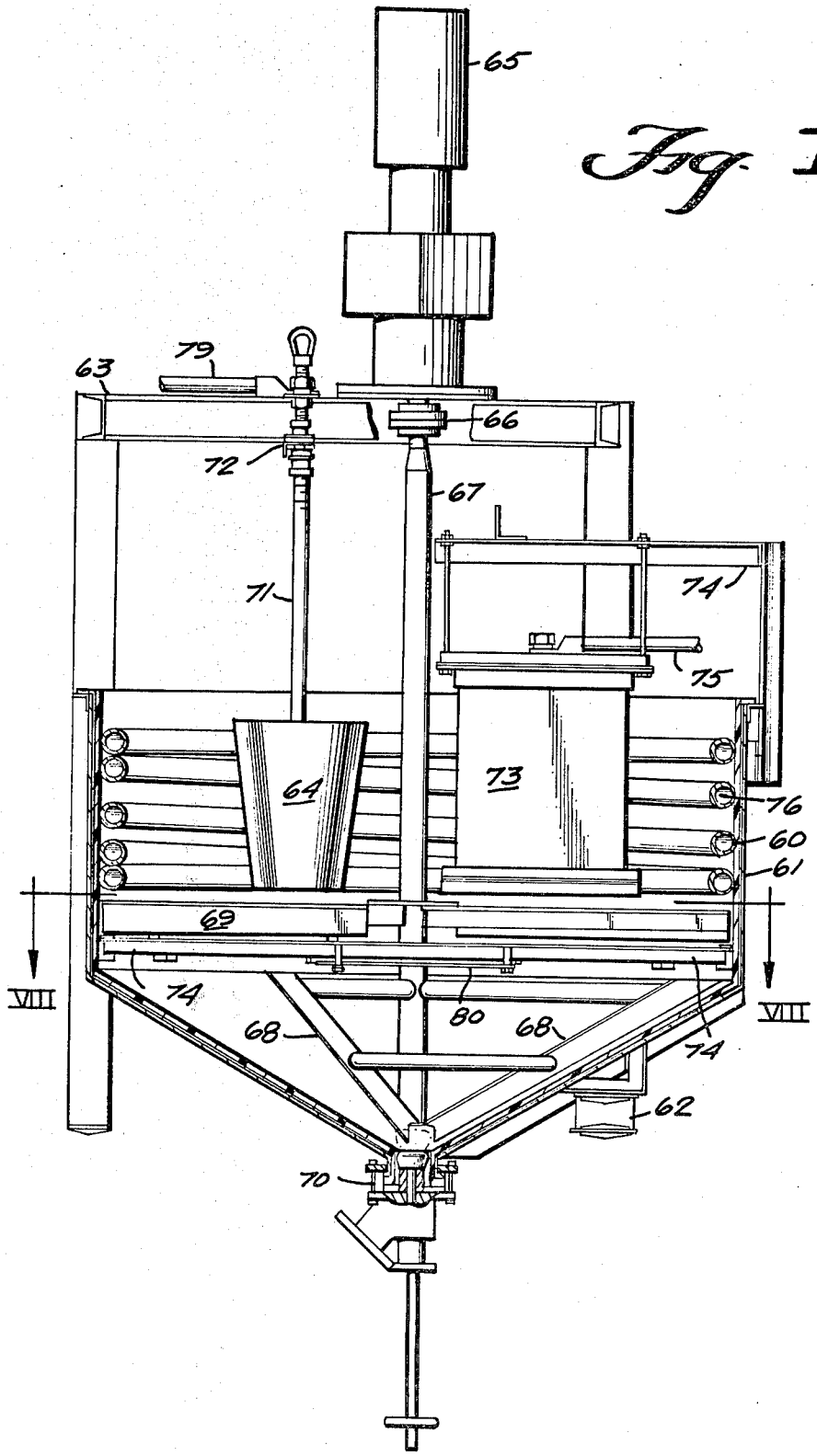
Fig. IV

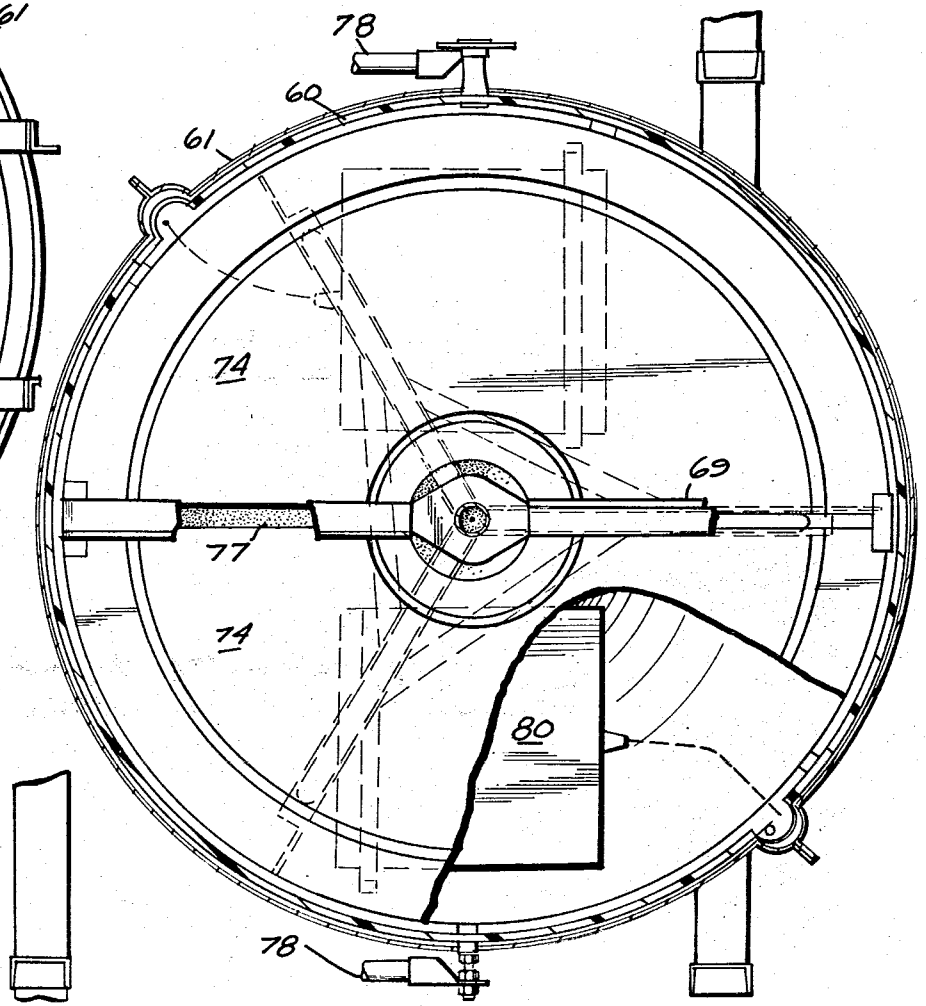
Fig. VI
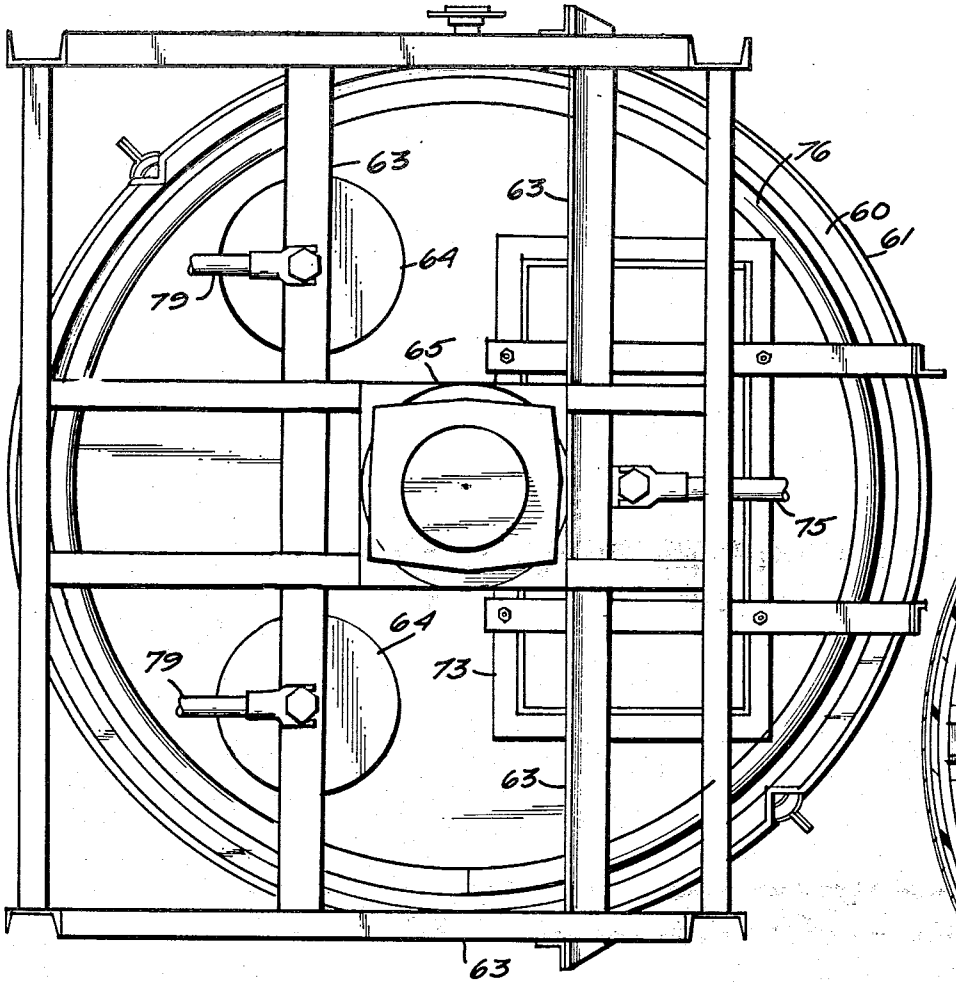
Fig. V

ELECTROLYSIS USING TWO ELECTROLYTICALLY CONDUCTING PHASES

SUMMARY OF THE INVENTION

This invention relates to a novel method of electrolysis, particularly for the deposition and/or recovery of metals in their elemental state and other redox reactions.

The electrolysis method provided by this invention can be used for, among other uses, electro-deposition of a metal in the form of dendrites, and for electro-plating a metal onto a substrate. It can also be used for electrolytically effecting chemical redox reactions, e.g., the oxidation or reduction of chemical species.

The method of this invention particularly uses an electrolyte system having at least two phases, one of which is aqueous while another is aqueous-immiscible, and wherein the inter-facial current passage is ionic rather than electronic.

BACKGROUND

Certain other two-phase electrolysis systems are already known. For instance, the mercury cell commonly used for the electrolysis of sodium chloride solutions to produce chlorine and sodium amalgam, and eventually sodium hydroxide, utilizes two phases, i.e., the aqueous sodium chloride and the metallic mercury. In this case, however, the mercury phase conducts electronically, i.e., by the movement of electrons as in any conducting metal. In reality the mercury phase behaves as a liquid cathode. Also in the sodium hydroxide—chlorine industry, electrolyses using two aqueous phases separated by an ion exchange membrane have been used. Here the sodium chloride solution forms the anolyte, evolving chlorine at the anode therein; the electrolyte on the other side of the membrane is aqueous sodium hydroxide in which there is a cathode evolving hydrogen. Thus, these are both aqueous phases, and but for the ion exchange membrane, the same would be miscible with each other.

Such systems are severely limited in regard to the types of electrochemical processes which can be conducted therein.

A further common and well known problem, typically in organic electrochemistry is in dealing with the oxidation or reduction of water insoluble species. Due to the typically dielectric character of, for instance, organic liquids, electrolysis techniques are generally unsatisfactory. Usually the approach to overcome, to some extent, this difficulty is to use a water-miscible co-solvent, e.g., ethanol or acetone, to co-solve the water-insoluble species in the aqueous phase. Another technique is to use a solubilizing compound such as an aromatic sulphonic acid which co-solves the insoluble species and which can also act as the electrolyte. Both these techniques are intended to produce a single water-miscible phase for the electrolysis, and the same are also limited in their applications. See, for example, *Organic Electrochemistry,* by M. M. Baizer Ed., published by Dekker, New York, 1973.

DESCRIPTION OF THE INVENTION

We have now found a novel process making it possible to conduct electrolyses using two immiscible phases, one aqueous, the other non-aqueous, but with both being electrolytically conducting. That is, the current passes therebetween by the ion movement rather than mere electron movement.

Thus the present invention essentially provides a novel method of electrolysis which comprises passing an electric current between two electrodes through an at least two-phase electrolyte system having as one phase an aqueous solution of an electrolyte with one of the electrodes immersed solely therein and as a second phase a water-immiscible liquid serving as the other electrolyte, and with another electrode immersed solely therein. This second non-aqueous phase generally contains or is substantially composed of a liquid (at the temperature employed) containing or composed of an organic salt having at least some true ionic character, but which is nonetheless substantially water-insoluble, or at least preferentially substantially soluble in an organic solvent used to form this water-immiscible phase.

While the said aqueous phase will ordinarily have a solution of a highly ionic salt, acid, or alkali, and can commonly have a high conductivity or low resistivity of e.g., from 5 to 10 ohms-cms, by contrast the non-aqueous water-immiscible phase used herein will normally have a much higher resistivity, e.g., of the order of 1000 ohm-cms. Electrolysis using the non-aqueous phase alone would therefore normally require very high voltages; whereas, using the process of the present invention, much lower cell voltages can be used. Thus, one advantage of this invention is that otherwise poorly conducting systems can now be operated at pragmatic, economically acceptable cell voltages.

Our invention can also be used very readily for electrolytic redox reactions with water immiscible species because the aqueous-immiscible electrolyte phase is usually a very good solvent for other (organic) water immiscible species. Thus, as an example, the tetraalkyl ammonium halostannites (which can be used as the aqueous-immiscible electrolyte phase in our process) are quite good solvents for various non-polar organic species, even for olefins such as ethylene. When the aqueous-immiscible electrolyte phase is a salt of a long chain (e.g., $C_6$ to $C_{24}$) carboxylic acid (e.g., sodium octanoate), then this phase is also a good solvent for other (saturated or unsaturated) carboxylic acids, alcohols and so on.

The accompanying drawings illustrate two basic electrode cell arrangements which may be used in the practice of this invention, and two presently preferred practical embodiments thereof:

FIG. I schematically illustrates a two-phase electrode cell using three electrodes, and three electrolytes, as described hereinafter;

FIG. II schematically illustrates a two-electrode two-phase system, as described hereinafter;

FIG. III schematically illustrates a two-electrode, three electrolyte cell embodiment; and FIGS. IV–VI illustrate a two electrode three electrolyte cell embodiment.

Considering FIG. II first, a suitable cell container (either rectangular, cylindrical, or of any other desired shape) 20 may be formed of a suitable corrosion-resistant and electrolytically stable material such as polypropylene. Suspended near the bottom of the cell 20 is an electrode 21 connected to an insulated current feeder line 22, which as shown would be connected to the cathode terminal of a direct current power source. In use, the cathode 21 will be completely and solely immersed within the aqueous-immiscible phase 24. The aqueous electrolyte, an anolyte as shown, 25 is here depicted as above the catholyte 24, being of lower specific gravity, with a liquid-liquid interface 26 therebetween. Suspended in the aqueous anolyte phase is an anode 23, connected by its feeder 27 to the anode direct current power supply. It will be understood that current passes between the two electrodes, and across the liquid-liquid interface 26. In the practice of this invention, such passage of electricity is ionically conducted.

The electrode used in the aqueous electrolyte phase can be either the cathode or the anode, and the electrode in the non-aqueous phase will be conversely an anode or a cathode, depending on the electrolytic process desired.

When the phases are of different specific gravities, one can float on the other with merely the liquid-liquid interface between them, as shown in FIG. II. Alternatively, the two immiscible phases (anolyte and catholyte) may be separated by an ion-exchange membrane or a porous separator, e.g., a ceramic or a filter cloth, and then be located side by side. In another practical embodiment described below, the anolyte is the aqueous phase floating on the heavier aqueous immiscible catholyte.

Also, as in an embodiment of the invention described below, one electrode may be a corrodible metal anode immersed in the aqueous anolyte, while the other electrode is an inert cathode immersed in the non-aqueous catholyte. If in this arrangement the corrodible anode is, e.g., tin, that electrode corrodes away during the electrolysis and dendrites of tin are deposited on the cathode. The invention thus provides, as one feature, a method of forming dendritic tin from a massive block of tin. Such dendritic tin is a valuable starting material for the preparation of organotin halides by direct reaction of tin with an organic halide.

When tin is the anode, the catholyte may suitably be an aqueous-immiscible tin salt electrolyte; an example of such a salt is a complex of formula $Cat^+SnX_3^-$, where $Cat^+$ is a group derived from a positively charged species such as the $R_zQ^+$ (defined below), and X is chlorine, bromine or iodine, or other mineral acid anion species.

An example of $R_zQ^+$ is tetrabutylammonium. In general R is an organic hydrocarbyl group (or similarly inert group including hydrocarbyl groups carrying inert substituents) which will form this onium ion; and Q represents N, P. As or Sb, in which case z is 4, or Q may be S or Se, in which case z is 3. Compounds of the formula $R_zQX$ may be used as catalysts or as reagents in the production of, e.g., organotin halides, and when so used, there is formed as a by-product a halogenotin complex, for instance of the formula $R_zQ^+SnX_3^-$, e.g., tetrabutylammonium bromostannite. The by-product formed in the direct reaction of tin with an organic halide in the presence of a compound of formula $Cat^+X^-$ is specifically suitable as a catholyte in a process for the electrolysis of tin according to the present invention.

Alternatively, when another metal is employed as the corrodible anode, then a complex of that metal would be formed with the $Cat^+X^-$ species.

Thus, instead of using tin as the anode, there may alternatively be used, for instance, an aluminum anode, with an aqueous solution of aluminum trichloride and sodium chloride as anolyte, the catholyte now suitably being of the formula $Cat^+AlCl_4^-$.

In still another system, a lead anode is used with an aqueous solution of lead carboxylate, e.g., of a $C_{10}$ alkanoic acid, and sodium chloride as the anolyte, the catholyte being a solution of a lead carboxylate in a carboxylic acid. This system makes possible the recovery of lead, in the form of dendrites deposited on a cathode, e.g., a lead cathode, with, for instance, scrap lead being used as the anode. Impure metals other than lead can similarly be used as the anode and obtained in purified form by this technique (particularly where the impurity metals have a significantly different electrode potential from that of the metal sought to be recovered).

Such other metals which may be used generally include those having a standard electrode potential (versus a normal hydrogen electrode) from about plus 1.5 volts down to about minus 1.66 volts, including such metals as silver, gold, platinum, palladium, copper, lead, tin, nickel, cobalt, indium, cadmium, iron, gallium, chromium, zinc, manganese, titanium, and aluminum.

As with lead, these other metals may also be used either with a suitably chosen $Cat^+X^-$ species or as a long-chain metal carboxylate. The choice of the organocarboxylic acid employed in forming the carboxylate is, of course, primarily dictated by the need to have an electrolyte system which is immiscible with the aqueous phase. That is, desirably the metal carboxylate, and the carboxylate acid itself, should be soluble to a degree of less than 10% in the aqueous phase at the temperature employed for the electrolysis process itself. Correspondingly, there may be some water which "dissolves" into the water-immiscible phase, but so long as that percentage of dissolved water is insufficient to interfere with the basic immiscibility and consequent separation of the two phases, it presents no significant problem in the practice of this invention. Generally, a carboxylic acid of at least six carbon atoms will be chosen for this purpose. Similarly, whatever $R_zQ^+$ species is selected, and whatever anion is selected, there must again be compliance with these basic requirements of immiscibility and solubility of the metal complex therewith.

Fundamentally, it will be appreciated that this invention thus uses as one feature a water-immiscible, generally an organic, liquid phase, which may in fact be a solution, and which contains a substantial concentration of an ion species (which is nonetheless substantially water-insoluble), while such phase is nonetheless relatively nonconductive by at least an order of magnitude with respect to the aqueous phase.

The aqueous phase electrolyte, by contrast, is desirably a highly conductive system, and this is easily established, as is already known in the art, by the introduction of a suitable inorganic salt, for instance. Alternatively, or in addition, to the salt, there may be used an alkali or an acid aqueous phase as such electrolyte. The particular choice of the anolyte system and of the catholyte system being determined and selected according to the particular electrolytic process desired to be conducted, in accordance with the foregoing principles.

Instead of a single corrodible anode such as, for instance, tin, aluminum or lead which is transferred electrolytically and deposited on the cathode, there may be used a three-anode system as illustrated in FIG. I.

In this system, the electrolysis cell 10 again has an electrode 11 connected to a suitably insulated feeder 12 to a power source (the negative power source being shown, but it could also be the positive source if desired), and this cathode (as shown) is fully immersed within the aqueous-immiscible catholyte phase 13. Above the catholyte phase 13 is the aqueous anolyte phase 14 with an interface 14*a* between the two phases. Also extending into the anolyte phase 14 is a chamber of compartment 15 having at least one wall member portion which is formed of an ion exchange membrane, which membrane will permit the passage of ions, while not permitting the mixing of the separate anolyte 16 with the anolyte 14. Extending into the chamber 15 is, suitably, a non-corrodible anode 17, again connected to a DC current power supply. Extending into the anolyte 14, hereinafter referred to in this embodiment as the "intermediate" anolyte, is a corrodible electrode 18, connected by its feeder 19 to the power supply. As shown, electrodes 17 and 18 are both anodes.

In such a system, the chamber 15 may contain as its anolyte 16 an aqueous sodium hydroxide solution, while the intermediate anolyte 14 may conveniently be an aqueous solution of a metal salt, e.g., a metal chloride such as sodium chloride. The catholyte 13 may be either a metal carboxylate solution in a carboxylic acid, as described above, or a metal complex with $Cat^+X^-$—both again being immiscible with the aqueous phase anolyte 14. Various metals may be used as the salt used in the anolyte 14 incluing variously, without limitation, cobalt, nickel, titanium, manganese, vanadium, etc.

The techniques permitted by the electrolysis cell of FIG. I include the method of recovering elemental metal from a dissolved salt thereof, which salt may in turn have been obtained as a waste product from an independent chemical process. The metal thus recovered may be used for the production of various metal compounds, including metal organic compounds. Such dissolved salt may be present in either the aqueous-immiscible phase or the aqueous phase, or both, with the metal being reduced to the elemental state at the cathode.

In particular, since the electrolytic process of this invention valuably produces dendritic metal species, which are highly reactive, the invention provides a means for forming valuable metal carboxylates (e.g., used as paint driers, for instance) directly from the dendritic metal formed and the desired carboxylic acid, the same being heated together with air or oxygen (outside the electrolysis cell) causing the dendritic metal to dissolve at good reaction speed with high yield by direct reaction with the carboxylic acid.

In the three electrode embodiment of FIG. I, if an alkali is used as the anolyte 16, oxygen will be evolved at the anode 17, as is necessary to balance the overall electrolytic reaction equation.

The two-phase electrolysis system of this invention can also be used for electrolyses involving organic species only. Thus, as an example, there may be used in the embodiment of FIG. I or FIG. II an inert anode 18 or 23, respectively, such as platinum, suspended in an aqueous sulphuric acid solution, as anolyte 14 or 25, respectively, which is in turn in interfacial contact with a water immiscible phase containing, e.g., acrylonitrile, adiponitrile and a conducting species such as a sodium carboxylate or a tetra-alkyl ammonium sulphonate or sulphate. Electrolyses thereof leads to oxygen evolution at the anode and hydrodimersation of acrylonitrile to make adiponitrile at the cathode.

Other organic species may be similarly reduced electrolytically by the process of this invention such as benzaldehyde to benzyl alcohol, benzil to benzylidene, salicaldehyde to the corresponding alcohol; nitrophenol to hydroxyaniline, or allyl bromide to propyl bromide. As with acrylonitrile, other reductive dimerization or polymerization, reactions using organic entities may also be performed electrolytically whenever the organic species suitable for such an electrolytic reduction will be soluble in the aqueous-immiscible catholyte phase.

The electrolytic method of this invention can also be used for electro-plating an alloy onto a cathodic substrate. For example, two or more metals may be used as anode—either as separate metal anodes (i.e., two anodes such as anode 23), or as a single alloy anode—with an aqueous solution of chlorides of these metals used as anolyte and water-insoluble chlorides of the metal(s), e.g., in the form $Bu_4N^+MCl_m^-$ (where Bu is butyl, M is the metal, and m is a number equal to the valency of the metal plus one), as catholyte. When two different corrodible anodes are employed the relative amounts of the metals deposited can be varied by the amounts of current independently supplied to said respective anodes.

To further illustrate the practice of this invention, a presently-preferred working embodiment of this invention is shown in the following example.

EXAMPLE

The apparatus used in this example was the cell schematically shown in the accompanying drawing of FIG. I.

This cell comprises a polypropylene tank 10, 40 cm×40 cm×25 cm, containing a stainless steel cathode 11, 35 cm×25 cm×0.3 cm connected to an insulated feeder 12. The bottom of the cell was loaded with tetrabutylammonium bromostannite ($Bu_4N^+SnBr_3^-$, prepared synthetically from $Bu_4NBr$ and $HSnBr_3$ solutions), (11 kg) as catholyte 13.

Above this, 16 liters of 20% NaBr solution in water was placed as the intermediate electrolyte 14. Dipping into the intermediate electrolyte was an ion-exchange membrane-covered box (Nafion#, duPont membrane) 15 containing NaOH solution 16 and a nickel anode 17. Also dipping into the intermediate electrolyte was a tin anode 18 held on a feeder 19.

The anodes 17 and 18 were connected to the positive terminal of a variable power supply and the cathode feeder 12 to the negative terminal. A current ranging from 40 amp at the beginning to 100 amp at the end was passed through the cell over a period of 17 hours. During this time the temperature in the cell rose to 75–°85°, the cell voltage at the start was 19 volts and this declined to 5 volts at the end. During this time 596 amp-hrs were passed through the tin anode 18 resulting in a loss of 1500 g of tin. 540 amp-hrs were passed through the nickel anode 17.

The combined anode currents—1136 amp-hrs—passed through the cathode 11 caused the deposition of fine dentritic tin particles (2513 g). 1320 g of this tin product were derived from the tin anode 18 and 1193 g came from the catholyte 13. Thus, the final catholyte phase comprised dendritic tin (2513 g), tetrabutylammonium bromide (3238 g), and unreacted tetrabutylammonium bromostannite (5040 g).

In this example, the catholyte was prepared as a special catholyte, but there could be used instead the halogenotin by-product complex which is formed in the production of organotin halides by the direct reaction of tin with an organic halide in the presence of reagent amounts of a compound of formula $Cat^+X^-$, e.g., of formula $R_zQ^+X^-$, as defined above. That overall reaction may be represented according to the stoichiometric equation $$2Sn+3RX+R_zQX \rightarrow R_3SnX+R_zQSnX_3.$$

At the end of the reaction the organotin halide produce is recovered by extraction in a hydrocarbon solvent, leaving a hydrocarbon-insoluble, water-insoluble yellow-khaki by-product which contains or consists of the $R_zQ^+SnX_3^-$. This is the halogenotin by-product complex which may be used as catholyte in this embodiment of the present invention.

Illustrations of such procedures are also shown in co-pending application entitled "Production of Organotin Halides", filed Jan. 1, 1983, Ser. No. 456,316, and also in my co-pending application entitled "Electrolysis of Tin Complexes", filed Jan. 1, 1983 Ser. No. 456,317, the disclosures of which are incorporated herein by reference.

For instance, one suitable practical cell for this electrolysis invention is illustrated in FIG. III. This cell has a polypropylene body 41 with a cross section of approximately 30 cm×30 cm and an overall height of approximately 45 cm. The cell has a polypropylene bottom valve 42 and is mounted on feet (not shown) so that the bottom inverted pyramidal part extends through a hole in a supporting platform. The cell is heated by external electrical heating tapes 43 and is insulated and clad 44. The cell has two further taps, 45 and 46, in its higher portion.

Internally the cell has two cathode plates 47 connected to cathode feeder lines 56. Above the cathodes there are two tin anodes 48 (one shown) mounted in mild steel feeders 58 which in turn are supported on insulated bushes on an anode support frame 49 which is screwed to the platform.

Alongside the tin anodes is a third anode 50 made of nickel. This nickel anode is supported on mild steel feeders 57 and held from the anode support frame. The nickel anode 50 is separated from the rest of the cell inside a compartment made up from outer clamping members 51, an inner member 52 and two ion exchange membranes 53. Parts 51 and 52 are U-shaped in section and are clamped together with bolts sandwiching the membranes 53 so that a five-sided compartment with an open top is formed.

The cell has two polypropylene scrapers 54, with blades, **54*a* which can be pushed across the top of the cathodes 47 to scrape and dislodge metal formed on the cathodes and allow this metal to fall into the bottom part of the cell (i.e., below the cathodes). The cell has an agitator on a shaft 55** connected to the motor (not shown). This agitator is used to stir the bottom phase containing such metal particles.

In operation the tin anode feeders 58 and the right-hand cathode feeder 56 are connected to one rectifier (not shown) and the nickel anode feeder 57 and the left-hand cathode feeder 56 are connected to another rectifier. The tin anodes can be adjusted up and down on their feeders 58.

The cell has been operated by loading it with 25.9 kg of mixed halogenotin complex by-product from the manufacture of tributyltin bromide as shown in respect to Table II of copending application "Production of Organotin Halides", referenced above, and 16 liters of 10% wt/volume sodium bromide solution. This resulted in a two-phase system with the halogenotin complex below the aqueous solution and with the interface therebetween about 1 cm above the cathode plates 47. Aqueous sodium hydroxide (25%, 2 l.) was poured into the anode compartment formed by 51, 52 and 53. The cell contents were heated to 75°–95° and current passed from both rectifiers. A total of 1103 amp-hrs was passed through the nickel anode and 1163 amp-hrs through the tin anodes. Currents ranging from 5 to 150 amps (aqueous-nonaqueous interfacial current densities of 5.5 $mA/cm^2$ to 167 $mA/cm^2$ respectively) were passed during this electrolysis and the relative currents passed through the tin anodes and the nickel anode were adjusted to give approximately the same number of coulombs through each anode system. The starting cell voltage was about 20 volts and this declined during the electrolysis to about 8–10 volts.

The electrolysis products were 17.7 liters of 30% wt/volume sodium bromide solution and 24 kg of a mixture of $Bu_4N^+Br^-$—dendritic tin—halogenotin by-product. The tin anodes had lost a total of 2.57 kg of tin.

In addition to the cell illustrated in FIG. III, for larger production purposes the cell construction illustrated in FIGS. IV, V and VI is presently preferred.

FIG. IV illustrates in cross section a 2000 ampere cell which would be equipped with conventional rectifiers and controls, etc. (not shown). In general, the construction of this cell is analogous to that of FIG. III. However, the polypropylene body 60 is in this instance supported by a mild steel casing 61 which sits in turn on load cells 62 (only one shown) which are held on a supporting platform. In common with the FIG. III apparatus, steel supporting structures 63 hold two tin, or other corrodible metal anodes 64 (one shown) and the drive motor 65. This agitator drive may be a variable DC motor coupled at 66 to the shaft 67 which drives the lower agitator blades 68 and scraper blades 69. The upper part of the combined agitator and scraper blades also serve as an agitator for the aqueous electrolyte phase. The scraper blades 69 serve a dual purpose of creating upward flow movement of the halogenometal complexes to replace electrolyzed material at the liquid-liquid interface, while also dislodging deposited metal from the cathode surface.

The conical bottom of the cell is fitted with a push-up-type valve 70 at the bottom of the cone to permit removal of metal dendrites and/or electrolyte from the cell. The push-up valve is useful in the event unstirred dendritic metal settles to form a crust, as this can then be broken open to allow drainage of the lower phase.

Each metal anode 64 may weigh, for instance, 100 to 200 kg at start-up, and are held on a threaded steel rod 71 supported on an insulated bushing structure 72, respectively connected to feeder cables 79. By this means the vertical position of the anodes can be adjusted up and down.

The non-corrodible anode compartment is shown as 73 and is simply a polypropylene box with an open top, and a bottom closed by an ion exchange membrane having suitable supports and seals. This anode chamber may be supported from the mild steel casing 61 by suitable steel work 74, and the chamber is fitted with a non-corrodible anode (not shown) connected to feeder cable 75.

The cathode plates 74 are here two semicircles of stainless steel supported on suitable polypropylene lugs within the cell and connected to the cathode cables 78 (see FIG. VI). Suitable plate heater 80 may be hung underneath the cathode plates. A cooling coil 76 is also arranged within the cell, and the water-immiscible catholyte phase interface with the aqueous anolyte solution may be approximately 1 cm above the level of the cathode plates although this level can vary according to most efficient operation of a given device. During full operation at, e.g., 2,000 amps and approximately 10 volts, the cooling coil 76 should be capable of removing approximately 20 kW.

FIG. VI is partly broken away to show the space or gap 77 between the cathode plates to permit dendritic metal particles to fall through to the lower conical section of the cell, as the same are dislodged by the scraper blades. This gap may be approximately 2 cm wide, and additionally a spacing of approximately 0.5 cm clearance is maintained between the circumference of the cathode plates and the polypropylene cell body.

The capacity of this cell can be designed to receive, for instance, some 450 kg of the halogenotin complex by-product (as described above), approximately 500 liters of 10% sodium bromide solution and approximately 100 liters of 25% sodium hydroxide solution for the nickel anode compartment 73, all to be heated with constant agitation to about 70°-80°.

At a current load of approximately 1,500 Faradays and about 20 hours running time at 2,000 amps dendritic tin production is a little under 90 kg with current production of about $Bu_4NBr$ of 120 Kg and NaBr of about 77 kg, with NaOH usage of about 30 kg. The loss of tin from the tin anodes is a little more than 44 kg, the balance of the dendritic tin coming from decomposition of the halogenotin complex.

It will be understood that the foregoing example is merely illustrative of the practice according to this invention. That is, while tin is there employed as the corrodible metal anode, and is obtained as the dendritic cathode deposit, any of the other metals mentioned hereinabove may be used in lieu of tin. Similarly, other $Cat^+$ species may be used, and other halogens (e.g., chlorine or iodine) may be used instead of bromine. The mineral acid anion represented generally by $X^-$ will of course be selected to avoid complications from the formation of insoluble metal salt species. Alternatively, the same procedure in principle may be employed using tin or one of the other metals but using an organic carboxylic acid which is itself substantially insoluble in an aqueous phase as the aqueous-immiscible catholyte. Additionally, a $Cat^+$ species may be formed from alkali or alkaline earth metal complex with polyoxygen or organic compounds such as diglyme, polyoxyalkylene glycol, glycol ether or crown ether.

In any given embodiment practiced according to this invention, the precise conditions to be employed for optimum results will be dictated by the various parameters which are adopted for the overall equipment in process. Thus, the geometry of the cell itself, and of the various electrodes, including the surface area of the electrolyte interface, will in part determine the performance and preferred operating conditions. Consequently, the current density applied for optimum results will vary substantially from system to system, and precise guidelines cannot therefore be laid down in advance. However, each of these conditions can be readily determined once the foregoing principles are revealed, as they are in accordance with this invention, and a person skilled in the art may easily adapt the procedures outlined above to whatever electrolytic reaction he desires to perform within the scope of the foregoing disclosure.

For instance, as will be appreciated, the temperature of the system is not itself critical to achieving operability, so long as the respective electrolytes are in the liquid state and below any adverse decomposition temperature. The interrelationship of temperature, applied current, concentrations and reaction velocity will of course be optimized in any given system for best results, and may otherwise vary broadly.

Accordingly, this invention is limited only by the spirit and scope of the following claims.

What we claim is:

1. A method of electrolysis, which comprises passing an electric current between two electrodes and through an at least two-phase electrolyte system having as a first phase an aqueous electrolyte solution, and as a second phase an aqueous-immiscible electrolytically conductive liquid with at least one electrode located solely therein, said first and second phases being in direct liquid-liquid interfacial contact with each other.

2. A method according to claim 1, wherein a first electrode is a corrodible metal anode immersed solely in said first aqueous solution as anolyte, and a second electrode is an inert cathode immersed solely in said aqueous-immiscible liquid as catholyte.

3. A method according to claim 2 in which said corrodible anode is made of tin.

4. A method according to claim 3, in which said catholyte is a halostannite complex of the formula $R_zQ^+SnX_3^-$ wherein R is an organic group, Q represents N, P As or Sb, in which case z is 4, or Q represents S or Se in which case z is 3, and X is I, Cl or Br.

5. A method according to claim 3, in which elemental tin is deposited on said cathode in dendritic form.

6. A method according to claim 1, in which a first electrode is a non-corrodible anode immersed solely in said first aqueous anolyte and a second electrode is an inert cathode solely immersed in an aqueous-immiscible liquid phase containing an at least partially ionic tin compound as catholyte, whereby upon passage of said current, elemental tin is recovered from said tin compound in said aqueous-immiscible phase.

7. A method according to claim 6, in which said tin compound catholyte is a halostannite complex of the formula $R_zQ^+SnX_3^-$ wherein R is an organic group, Q represents N, P As or Sb, in which case z is 4, or Q represents S or Se in which case z is 3, and X is I, Cl or Br.

8. A method according to claim 7 in which tin is precipitated from said catholyte and deposited on said cathode in dendritic form.

9. A method according to claim 6, in which said anode is nickel, graphite or stainless steel.

10. A method according to claim 1 having two aqueous anolytes wherein a first anode is immersed in an alkali metal hydroxide anolyte, which anolyte is in contact with a second aqueous aqueous anolyte solely through a cation permeable membrane.

11. A method as in claim 10 wherein said second anolyte is an aqueous solution of an alkali metal halide.

12. A method according to claim 10 wherein there is also a second, corrodible, metal anode located solely in said second anolyte.

13. A method as in claim 1, in which one electrode is a corrodible anode located solely in the aqueous phase and the other electrode is a non-corrodible cathode located solely in the non-aqueous phase.

14. A method according to claim 1, wherein said aqueous-immiscible electrolyte is a cobalt or nickel salt of a long-chain organic carboxylic acid in the said carboxylic acid; one electrode, used as the anode, is formed of cobalt or nickel, and is located solely in said aqueous-immiscible electrolyte; the other electrode, used as the cathode, is inert under the electrolysis conditions, and said cathode is located solely in an aqueous solution of an alkali metal salt of said carboxylic acid, whereby upon said passing of electric current, cobalt or nickel, respectively, from said anode is converted to its carboxylic acid salt.

15. A method according to claim 1, wherein one electrode is used as a non-corrodible anode, an aqueous solution of a soluble cobalt salt is used as anolyte, the other electrode is an inert cathode, and an aqueous-immiscible liquid containing a water-insoluble cobalt salt is used as catholyte, whereby upon passing said electrical current, cobalt ions are removed from said aqueous anolyte and deposited as an elemental cobalt at said cathode.

16. A method according to claim 2 wherein said corrodible metal anode is formed of a metal having a standard electrode potential from about plus 1.5 volts down to about minus 1.66 volts.

17. A method according to claim 2 wherein said corrodible metal anode is formed of a metal of the group of silver, gold, platinum, palladium, copper, lead, tin, nickel, cobalt, indium, cadmium, iron, gallium, chromium, zinc, manganese, titanium, and aluminum.

18. A method according to claim 1 wherein an organic compound is contained in said aqueous-immiscible liquid, and undergoes electrolytic reduction as a result of the said passing of said electric current.

19. A method according to claim 1, wherein a first corrodible electrode is formed of a cobalt or nickel metal, and is solely in contact with said aqueous electrolyte as anolyte, said aqueous-immiscible electrolyte as catholyte is composed of a cobalt or nickel salt of a long-chain carboxylic acid and a second inert electrode, used as the cathode, is solely in contact with said catholyte whereby upon passage of said current the anode corrodes providing cobalt or nickel ions, respectively, in said aqueous phase and which ions then move into said catholyte and are deposited as elemental cobalt or nickel, respectively, at said cathode.

* * * * *